US006223982B1

(12) United States Patent
Dunn

(10) Patent No.: US 6,223,982 B1
(45) Date of Patent: May 1, 2001

(54) IMPACT RESISTANT MAILBOX SUPPORT

(76) Inventor: Tristram C. Dunn, 4 Walmsley Rd., Darien, CT (US) 06820

( * ) Notice: Subject to any disclaimer, the term of this patent is extended or adjusted under 35 U.S.C. 154(b) by 0 days.

(21) Appl. No.: 09/264,083

(22) Filed: Mar. 5, 1999

(51) Int. Cl.[7] ..... B65D 91/00
(52) U.S. Cl. ..... 232/39; 248/548; 248/560
(58) Field of Search ..... 232/39; 248/548, 248/900, 417, 551, 573, 575, 560; D99/32

(56) References Cited

U.S. PATENT DOCUMENTS 5,029,783 * 7/1991 Alvarez ..... 232/39 X
5,160,111 * 11/1992 Hugron .
5,207,377 5/1993 Brecht .
5,214,886 * 6/1993 Hugron .
5,215,283 6/1993 Gould .
5,302,148 * 4/1994 Heinz .
5,356,072 10/1994 Thomas .
5,411,206 5/1995 Latham et al. .
5,628,667 * 5/1997 Levil .
5,803,353 * 9/1998 Fisher ..... 232/39

* cited by examiner

*Primary Examiner*—Terry Lee Melius
*Assistant Examiner*—William L. Miller
(74) *Attorney, Agent, or Firm*—Robert A. Seemann

(57) ABSTRACT

A mailbox post includes a movable joint, an elastic element connected to said post at two locations, one on each side of the joint, supportive against tension force between the two locations and connected to the post at a third location between the two locations, supportive against twisting force on the joint.

13 Claims, 3 Drawing Sheets

IMPACT RESISTANT MAILBOX SUPPORT

BACKGROUND OF THE INVENTION

1. Field of the Invention

The invention pertains to post mounted mailbox assemblies, more particularly to an assembly that reduces the damaging effect on a mailbox and post supporting the mailbox from impact by a stick or other object applied with force against the mailbox.

2. Description of the Prior Art

Daily, mailboxes are damaged or destroyed by strikes from balls, snow, passing vehicles, vandals, sticks, or other impact sources.

The prior art is replete with patented designs for protecting a mailbox and mounting post from accidental or deliberate lateral force or strike against the mailbox or the post.

U.S. Pat. No. 5,207,377 patented May 4, 1993 by F. R. Brecht describes a mailbox container portion mounted on a bellows configured so that the upright mailbox will laterally deflect when struck by a physical object and maintain its deflected state until physically returned to the upright position.

U.S. Pat. No. 5,215,283 patented Jun. 1, 1993 by R. D. Gould describes a mailbox mounted on a lateral arm, offset from a tubular upper section mounted in a tubular lower section of an upright post for relative rotation about a vertical axis. A collar having an angled cam surface rotates the upper section about the vertical longitudinal axis between displaced and non-displaced positions under a normal bias of gravity. A spring attached to a transverse bolt or pin in the lower section and to a threaded follower on a vertically aligned threaded tensioning adjustment rod adds additional normal bias to the cam surface to bias the upper section toward the non-displaced position. An external spring is attached over the top of the upper section to the top of the rod and to the head of the transverse bolt.

U.S. Pat. No. 5,356,072 patented Oct. 18, 1994 by F. P. Thomas describes a mailbox shock mounted on a horizontal post by a plurality of anchor assemblies. Each of the plurality of anchor assemblies comprises a compression spring mounted between a side wall of the mailbox and the post on a horizontal core. The core comprises a tubular shank on a horizontal nail that passes through the sidewall of the mailbox and into the post.

U.S. Pat. No. 5,411,206 patented May 2, 1995 by Latham et al., describes an armor clad mailbox mounted on a horizontal arm configured so that it hangs below the arm and is rotatable about the axis of the arm. The arm is mounted on a two piece vertical pole, rotatable about the vertical axis of the pole. The vertical pole is tilted slightly from normal to the ground so that the horizontal arm will rotate back to the lowest position around the vertical axis.

SUMMARY OF THE INVENTION

It is one object of the invention to provide a mailbox that yields to lateral impact.

It is another object of the invention to provide a mailbox assembly that displaces from impact against the mailbox or support post from any direction about a vertical axis.

It is another object that the mailbox assembly automatically returns to its non-displaced position after it is displaced by impact.

A mailbox support includes a post, a foldable joint of the post upon which the post can fold away from the axis of the post, the foldable joint including a first face of the joint drawn toward a second face of the joint by an elastic element that is mounted in the post supportive against tensional force, passing through the first face and the second face.

A portion of the first face is connected to the elastic element and is configured for receiving torsion force from the elastic element for rotating the joint on the axis. The first face includes an opening configured to sufficiently fit the circumferential shape of the elastic element to receive torsion force from the elastic element for rotating the joint on the axis.

A portion of the second face is connected to the elastic element and is configured for receiving torsion force from the elastic element for rotating the joint on the axis. The second face is adjacent to the first face.

One of the first face and the second face includes a cam that rotates the face on the axis to a predetermined position on the other face when the two faces are drawn together.

A slot on one of the first face and the second face, and a protuberance on the other face is configured to be received by the slot when the first face is rotated on the axis relative to the second face.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
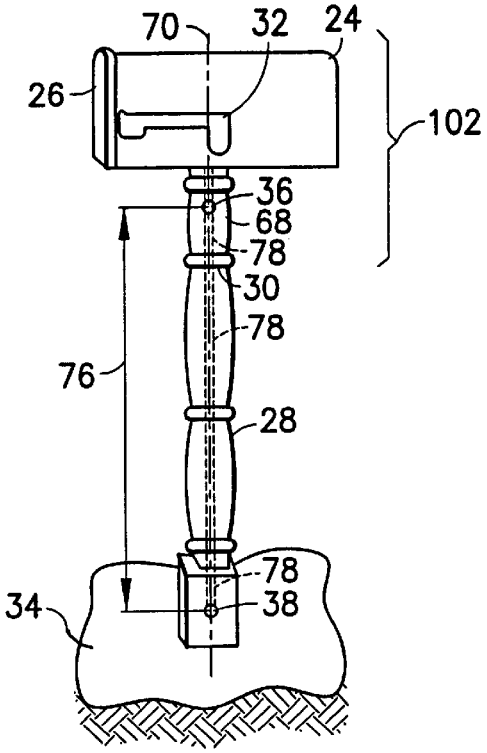
FIG. 1 is a right side view of a mailbox on a post of the invention.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figure 2:
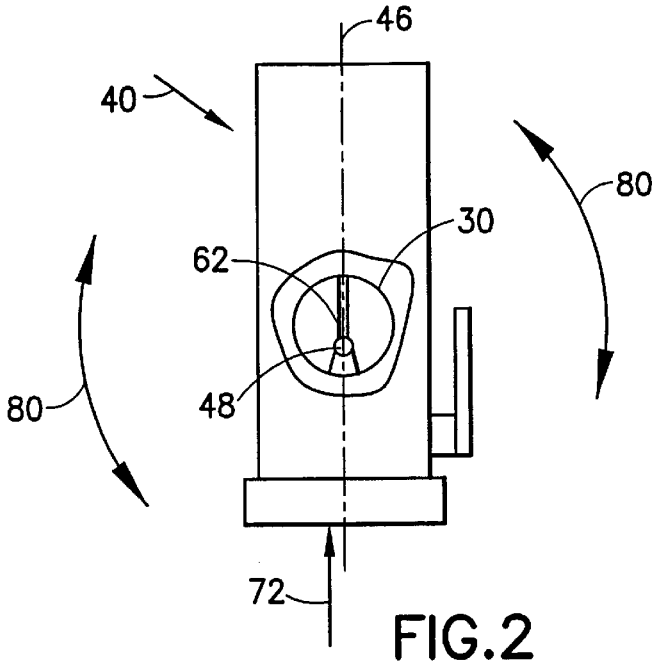
FIG. 2 is a top view of the mailbox, the joint of the post being shown in dotted line. The elastic element is not shown.

Referring to FIGS. 1 and 2, mailbox 24 includes door 26 and mail to go notification flag 32. Mailbox 24 is mounted on post 28 which is fastened in ground 34. The mailbox assembly has foldable joint 30 that is in about the upper ⅓ to ¼ portion of the regulation height of the mailbox from the ground.

Elastic 78 is stretchably mounted within post 28 by pins 36 and 38.

The mailbox is aligned with axis 46. Ball 48 is centered in groove 62.

The mailbox can rotate 80 out of alignment with centerline 46 on vertical axis 70 on joint 30. When the mailbox is rotated out of alignment with centerline 46, groove 62 moves laterally away from ball 48.

The mailbox will rotate when it is struck laterally in a direction adjacent to vertical axis 70.

Figure 3:
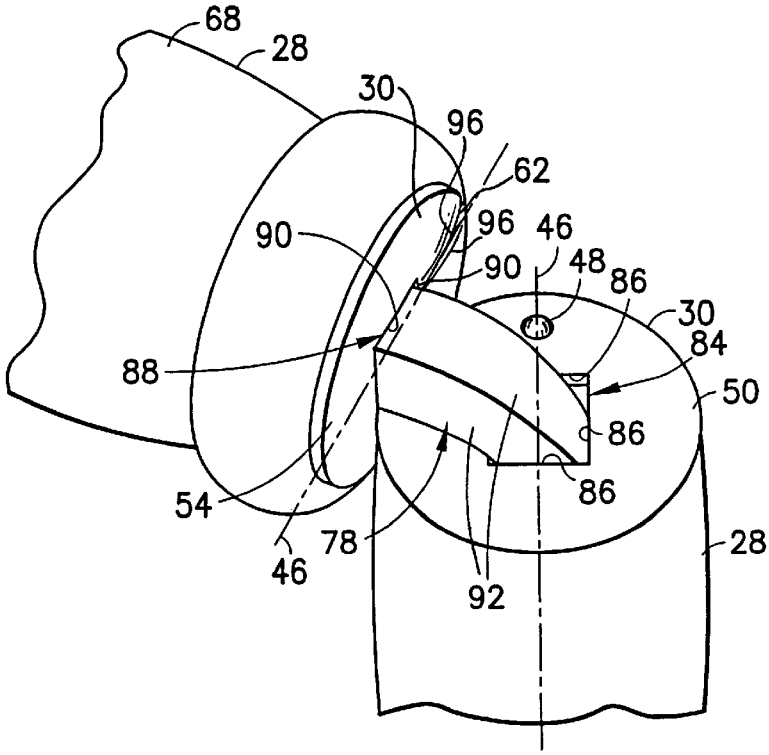
FIG. 3 is a rear view of the joint of the post, folded to a side.

In FIG. 3, post 28 is folded over as a result of a blow to the mailbox along line 40 of FIG. 2 transverse to center line 46. Center line 46 passes through ball 48 which is mounted on face 50 of joint 30. Face 50 is generally normal to vertical axis 70 of post 28.

Groove 62 in face 54 of joint 30 also coincides with center line 46 when face 54 is resting on face 50 and groove 62 receives ball 48.

When the mailbox is struck, the mailbox and portion 68 of the post are thrown as one off from vertical axis 70.

Figure 4:
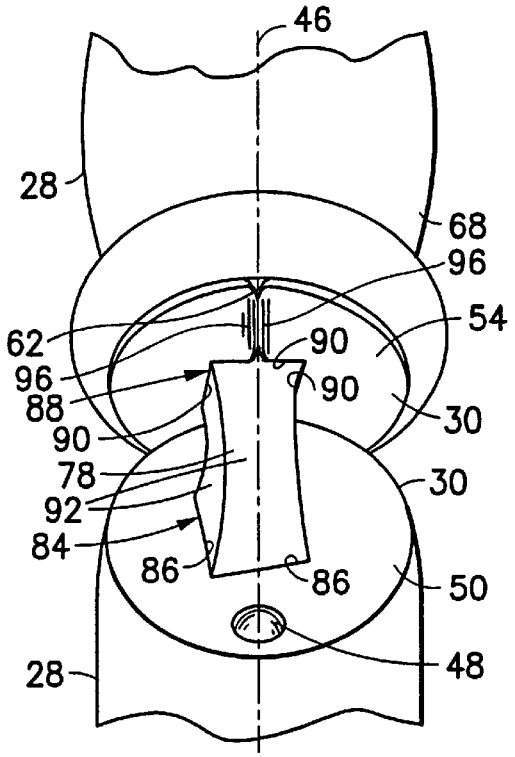
FIG. 4 is a front view of the joint of the post, folded backward.
Figure 5:
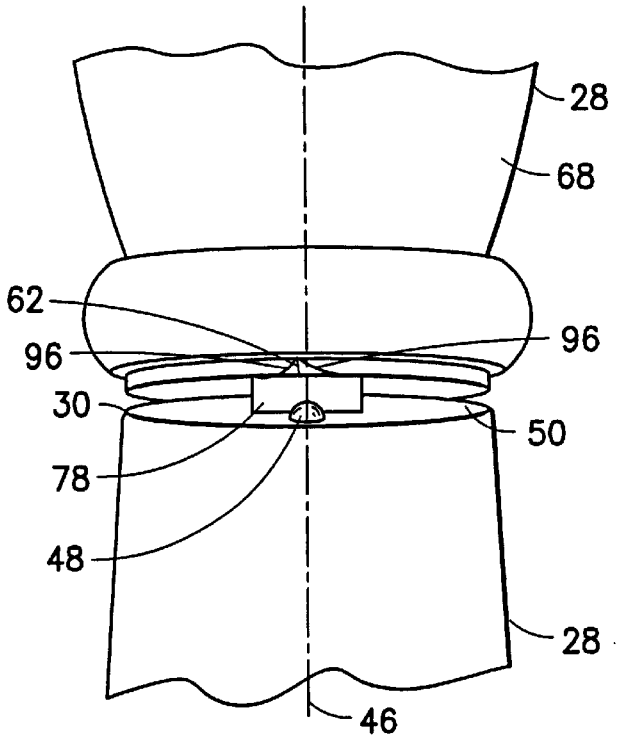
FIG. 5 is a front view of the joint of the post, folded backward slightly and rotated slightly.
Figure 6:
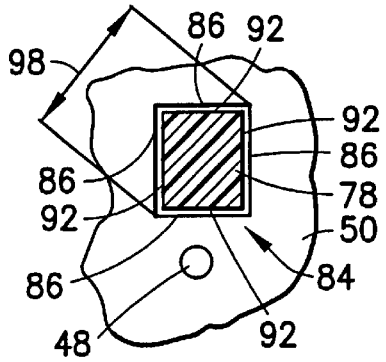
FIG. 6 is a top view of a face of a joint of the invention, showing an elastic element in cross section.

In FIG. 4, post 28 is folded over as a result of a blow to the mailbox along direction line 72 of FIG. 2. Elastic element 78 is stretched when the faces 50 and 54 are moved apart by folding of the joint. The faces are pulled back together by elastic element 78 when it resiles, thus bringing post 28 in line with axis 70. Elastic element 78 may be made of rubber, metal coil or other elastic material.

Referring to FIGS. 2–6, post portion 68 and the box rotate 80 when the mailbox is struck. Inward curving walls 96 of groove 62 move out of alignment with ball 48 in FIG. 5.

Elastic 78 is non-circular as viewed in cross section. Central openings 84 and 88 inner walls 86 and 90 closely fit the cross section configuration of outer wall 92 of the elastic element, so that when it resiles it rotates the faces toward alignment with center line 46. An elastic of large diameter 98 and high resilient force brings the mailbox into alignment with axis 70. Vibration at joint 30 during movement to alignment helps overcome friction between faces 50 and 54. Under the clamping together force of the elastic element the inward curving walls 96 of groove 62 align the groove with ball 48, which brings groove 62 in alignment with center line 46. Thus mailbox 24 returns into alignment with center line 46.

An elastic 78 made of neoprene rubber having a durometer hardness "Shore A" 60 hardness about between tire thread and shoe heel, 1" by 1" square cross section will rotate a 3–6 pound mailbox assembly 102, with mail contained, by rotational torque it applies to inner walls it contacts of openings 84 and 88 into close alignment with centerline 46 so that the mailbox is aligned for its functional use. An approximately three foot length of elastic provides sufficient stretch for the fold. Various changes may be made in materials and dimensions without departing from the spirit and scope of the invention.

Elastic element 78 is fastened at two spaced apart 76 fasteners 36 and 38 supportive against tension force between the fasteners and is confined at two longitudinally adjacent or close together inner walls 86 and 90 supportive against torsion or twisting force between inner walls 86 and 90, between fastener pins 36 and 38.

Figure 7:
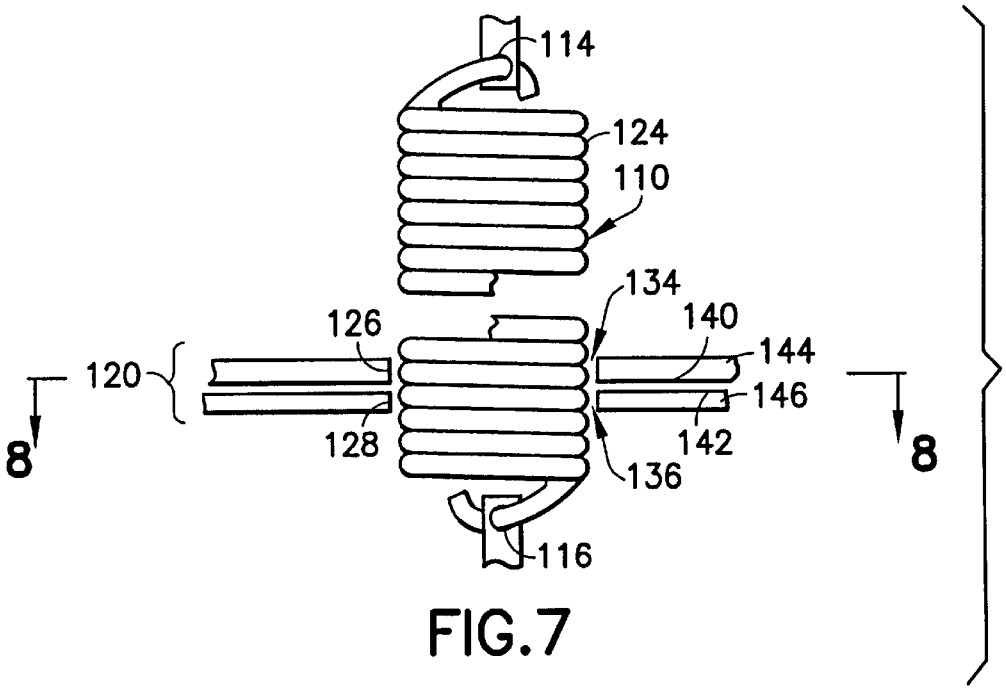
FIG. 7 is a side view of another elastic element and joint of the invention.
Figure 8:
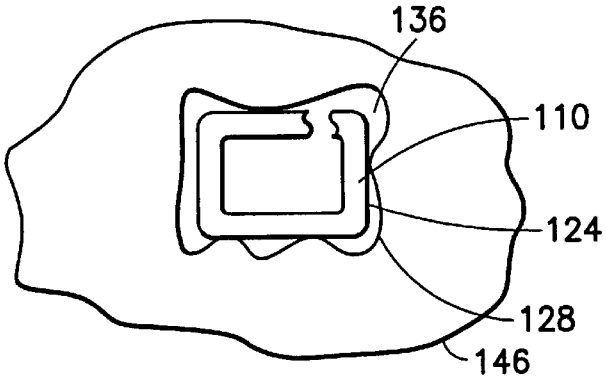
FIG. 8 is a top view of the elastic element and joint of FIG. 7 taken along 8—8.

Referring to FIGS. 7 & 8, elastic element 110 is made of spring wire. It is square in cross section and is attached to a mailbox post by spaced apart eyelets 114 and 116 respectively above and below rotatable, foldable, joint 120 so that elastic element 110 extends longitudinally under tension force. The non circular outer wall 124 of elastic element 110 is contacted by the inner walls 126 and 128 respectively of openings 134 and 136 in adjacent generally parallel faces 140 and 142 of plates 144, 146 so that the elastic element is twisted by the contact with walls 126 and 128 when one plate is rotated about the elastic element with respect to the other plate.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A mailbox support comprising:

a post having a longitudinal axis, a foldable joint of the post upon which the post can fold away from the axis in more than two directions, the foldable joint comprising a first face of said joint drawn toward a second face of said joint by an elastic element mounted in said post supportive against tensional force, passing through a first central opening in said first face and through a second central opening in said second face, said longitudinal axis passing through the first and second openings, said first face being rotatable on said axis relative to said second face, a portion of said first face in contact with said elastic element configured for receiving torsion force from said elastic element for rotating said first face by said elastic element on said longitudinal axis relative to said second face.

2. The mailbox support of claim 1 wherein said elastic element comprises a non-circular circumferential shape, and said first opening is configured to sufficiently fit said non-circular circumferential shape of said elastic element to receive torsion force from said elastic element for said rotating of said first face by said elastic element on said longitudinal axis.

3. The mailbox support of claim 1 wherein said elastic element comprises a non-circular circumferential shape, and said second face is configured to sufficiently fit said non-circular circumferential shape for receiving torsion force from said elastic element for said rotating of said first face on said longitudinal axis.

4. The mailbox support of claim 3 wherein said second face is adjacent to said first face.

5. The mailbox support of claim 1 further comprising:

one of said first face and said second face comprising a cam that rotates one of said first face and said second face on said longitudinal axis to a predetermined position on the other face when the two faces are drawn together by said elastic element.

6. The mailbox support of claim 1 further comprising a slot on one of said first face and said second face, and a protuberance on the other face configured to be received by the slot when the first face is rotated on the axis relative to the second face.

7. A mailbox support comprising:

a post having a longitudinal axis, a first end and a second end, a foldable joint of said post between the first and second end upon which said post can fold away from the axis, an elastic element comprising a non-circular circumferential shape, connected to said post at two locations, one on each side of said joint, resistive to tension force between said two locations and connected to said post at a third location adjacent to said joint configured to fit said non-circular circumferential shape for receiving torsion force from said elastic element for relative twisting around the axis of portions of said post at said joint.

8. The mailbox support of claim 7 wherein said elastic element is connected to said post at a fourth location adjacent to said third location, supportive against twisting force on said joint.

9. The mailbox support of claim 7 wherein said two locations are spaced apart along said axis.

10. The mailbox support of claim 7 wherein said third location is spaced from at least one of said first and said second location.

11. The mailbox support of claim 7 wherein said elastic element is connected to said post at a fourth location on the opposite side of the joint from said third location, resistive to relative twisting of portions of said post at said joint.

12. The mailbox support of claim 11 wherein said fourth location is adjacent to said third location.

13. An impact resistant mailbox comprising:

a mailbox comprising a mail status flag, mounted on a post having a longitudinal axis, a first end and a second end, a foldable joint of said post between said first end and said second end upon which said post can fold away from the axis, an elastic element connected to said post at two locations, one on each side of said joint, supportive against tension force between said two locations and connected to said post at a third location between said two locations, supportive against twisting force on said joint.

* * * * *